US005901762A

United States Patent [19]

Rollins

[11] Patent Number: 5,901,762

[45] Date of Patent: May 11, 1999

[54] SAND BAG FILLING DEVICE

[76] Inventor: Troy E. Rollins, 65 Hillbilly La., Coats, N.C. 27521

[21] Appl. No.: 09/082,676

[22] Filed: May 21, 1998

[51] Int. Cl.[6] ..... B65B 1/12

[52] U.S. Cl. ..... 141/360; 141/231; 141/313; 141/317

[58] Field of Search ..... 141/10, 313–317, 141/231, 360, 362

[56] References Cited

U.S. PATENT DOCUMENTS

| | | | |
|---|---|---|---|
| 2,130,005 | 9/1938 | Gay | 141/313 |
| 4,819,701 | 4/1989 | Thornton | 141/231 |
| 5,215,127 | 6/1993 | Bergeron | 141/10 |
| 5,425,403 | 6/1995 | Herrmann | 141/314 |
| 5,641,008 | 6/1997 | Ellis | 141/231 |
| 5,740,950 | 4/1998 | Kanzler et al. | 141/313 |

*Primary Examiner*—J. Casimer Jacyna

[57] ABSTRACT

A new sand bag filling device for taking bulk sand and filling sand bags with the bulk sand on demand. The inventive device includes a hopper having interior space, a top, a bottom, a pair of end walls, and a pair side walls extending between the end walls. The top of the hopper has an opening into the interior space of the hopper while the bottom of the hopper has ground engaging members. A conduit outwardly extends from one of the end walls of the hopper away from the hopper. The conduit has a first opening into the interior space of the hopper and an exterior second opening outside the hopper. An auger member is rotatably mounted in the interior space of the hopper. The auger member extends from the interior space of the hopper into the conduit through the first opening of the conduit so that its screw portion is extended into the conduit. A motor is proved for rotating the auger member in a direction.

6 Claims, 2 Drawing Sheets

SAND BAG FILLING DEVICE

BACKGROUND OF THE INVENTION

1. Field of the Invention

The present invention relates to sand bag filling devices and more particularly pertains to a new sand bag filling device for taking bulk sand and filling sand bags with the bulk sand on demand.

2. Description of the Prior Art

The use of sand bag filling devices is known in the prior art. More specifically, sand bag filling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art sand bag filling devices include U.S. Pat. No. 4,585,041; U.S. Pat. No. 5,215,127; U.S. Pat. No. Des. 320,800; U.S. Pat. No. 5,121,775; U.S. Pat. No. 4,184,522; and U.S. Pat. No. 4,763,702.

While these devices fulfill their respective, particular objectives and requirements, the aforementioned patents do not disclose a new sand bag filling device. The inventive device includes a hopper having interior space, a top, a bottom, a pair of end walls, and a pair side walls extending between the end walls. The top of the hopper has an opening into the interior space of the hopper while the bottom of the hopper has ground engaging members. A conduit outwardly extends from one of the end walls of the hopper away from the hopper. The conduit has a first opening into the interior space of the hopper and an exterior second opening outside the hopper. An auger member is rotatably mounted in the interior space of the hopper. The auger member extends from the interior space of the hopper into the conduit through the first opening of the conduit so that its screw portion is extended into the conduit. A motor is proved for rotating the auger member in a direction.

In these respects, the sand bag filling device according to the present invention substantially departs from the conventional concepts and designs of the prior art, and in so doing provides an apparatus primarily developed for the purpose of taking bulk sand and filling sand bags with the bulk sand on demand.

SUMMARY OF THE INVENTION

In view of the foregoing disadvantages inherent in the known types of sand bag filling devices now present in the prior art, the present invention provides a new sand bag filling device construction wherein the same can be utilized for taking bulk sand and filling sand bags with the bulk sand on demand.

The general purpose of the present invention, which will be described subsequently in greater detail, is to provide a new sand bag filling device apparatus and method which has many of the advantages of the sand bag filling devices mentioned heretofore and many novel features that result in a new sand bag filling device which is not anticipated, rendered obvious, suggested, or even implied by any of the prior art sand bag filling devices, either alone or in any combination thereof.

To attain this, the present invention generally comprises a hopper having interior space, a top, a bottom, a pair of end walls, and a pair side walls extending between the end walls. The top of the hopper has an opening into the interior space of the hopper while the bottom of the hopper has ground engaging members. A conduit outwardly extends from one of the end walls of the hopper away from the hopper. The conduit has a first opening into the interior space of the hopper and an exterior second opening outside the hopper. An auger member is rotatably mounted in the interior space of the hopper. The auger member extends from the interior space of the hopper into the conduit through the first opening of the conduit so that its screw portion is extended into the conduit. A motor is proved for rotating the auger member in a direction.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sand bag filling device apparatus and method which has many of the advantages of the sand bag filling devices mentioned heretofore and many novel features that result in a new sand bag filling device which is not anticipated, rendered obvious, suggested, or even implied by any of the prior art sand bag filling devices, either alone or in any combination thereof.

It is another object of the present invention to provide a new sand bag filling device which may be easily and efficiently manufactured and marketed.

It is a further object of the present invention to provide a new sand bag filling device which is of a durable and reliable construction.

An even further object of the present invention is to provide a new sand bag filling device which is susceptible of a low cost of manufacture with regard to both materials and labor, and which accordingly is then susceptible of low prices of sale to the consuming public, thereby making such sand bag filling device economically available to the buying public.

Still yet another object of the present invention is to provide a new sand bag filling device which provides in the apparatuses and methods of the prior art some of the advantages thereof, while simultaneously overcoming some of the disadvantages normally associated therewith.

Still another object of the present invention is to provide a new sand bag filling device for taking bulk sand and filling sand bags with the bulk sand on demand.

Yet another object of the present invention is to provide a new sand bag filling device which includes a hopper having interior space, a top, a bottom, a pair of end walls, and a pair side walls extending between the end walls. The top of the hopper has an opening into the interior space of the hopper while the bottom of the hopper has ground engaging members. A conduit outwardly extends from one of the end walls of the hopper away from the hopper. The conduit has a first opening into the interior space of the hopper and an exterior second opening outside the hopper. An auger member is rotatably mounted in the interior space of the hopper. The auger member extends from the interior space of the hopper into the conduit through the first opening of the conduit so that its screw portion is extended into the conduit. A motor is proved for rotating the auger member in a direction.

Still yet another object of the present invention is to provide a new sand bag filling device that can quickly fill sandbags faster than by hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description make reference to the annexed drawings wherein.

DESCRIPTION OF THE PREFERRED EMBODIMENT

Figure 1:
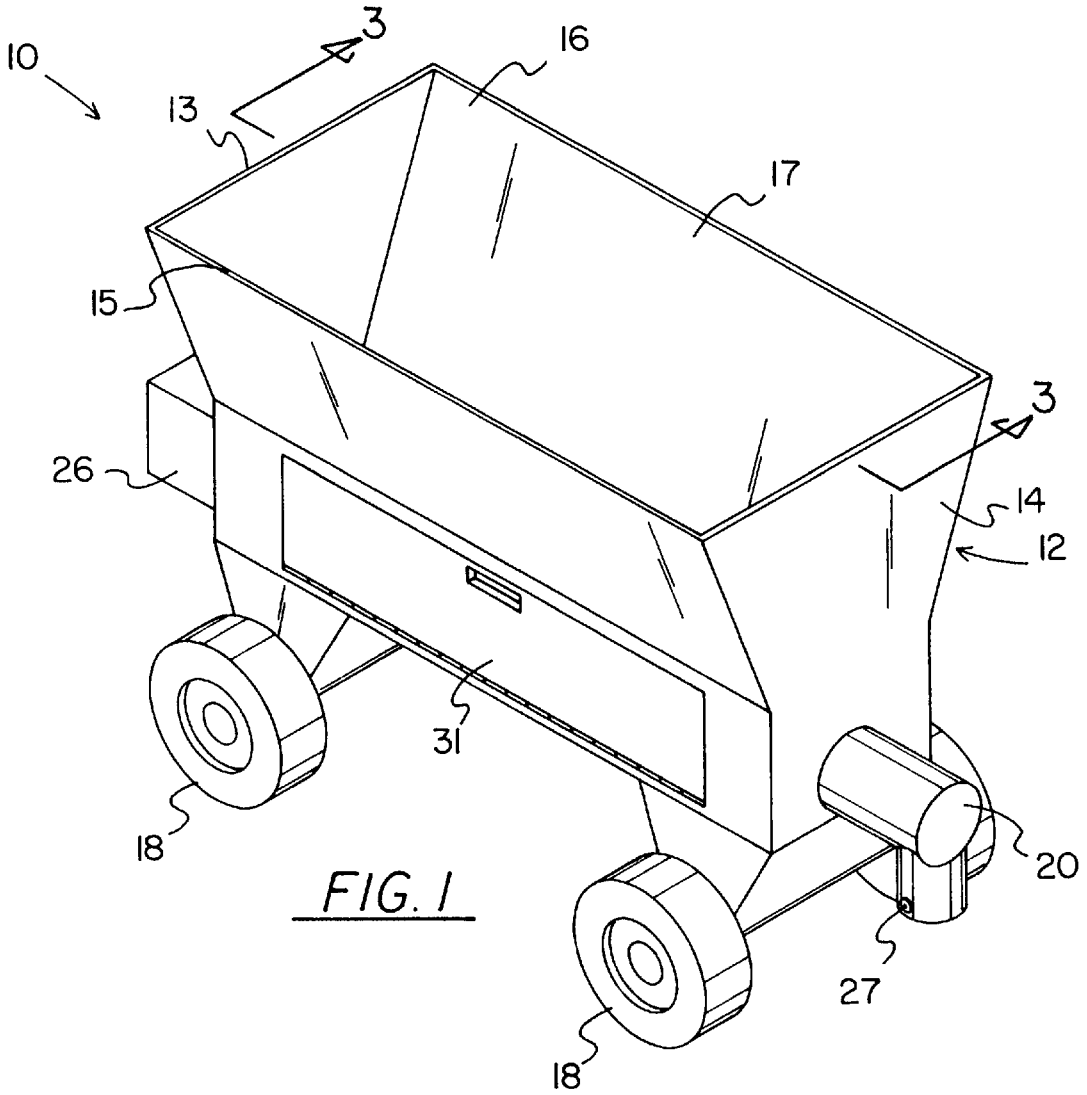
FIG. 1 is a schematic perspective view of a new sand bag filling device according to the present invention.
Figure 2:
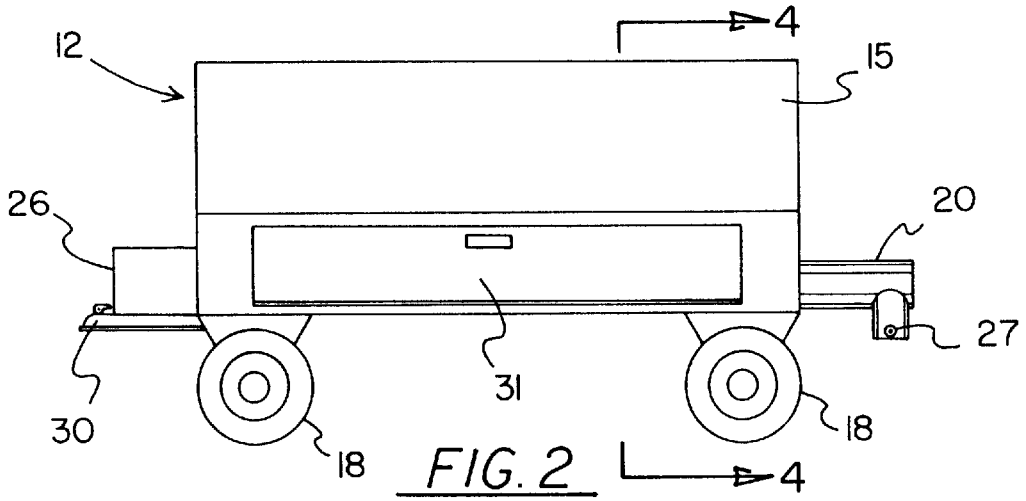
FIG. 2 is a schematic side view of the present invention.

With reference now to the drawings, and in particular to FIGS. 1 through 4 thereof, a new sand bag filling device embodying the principles and concepts of the present invention and generally designated by the reference numeral 10 will be described.

As best illustrated in FIGS. 1 through 4, the sand bag filling device 10 generally comprises a hopper 12 having interior space, a top, a bottom, a pair of end walls 13,14, and a pair side walls 15,16 extending between the end walls 13,14. The top of the hopper 12 has an opening 17 into the interior space of the hopper 12 while the bottom of the hopper 12 has ground engaging members 18. A conduit 20 outwardly extends from one of the end walls 14 of the hopper 12 away from the hopper 12. The conduit 20 has a first opening 21 into the interior space of the hopper 12 and an exterior second opening 22 outside the hopper 12. An auger member 24 is rotatably mounted in the interior space of the hopper 12. The auger member 24 extends from the interior space of the hopper 12 into the conduit 20 through the first opening 21 of the conduit 20 so that its screw portion 25 is extended into the conduit 20. A motor 26 is proved for rotating the auger member 24 in a direction.

Figure 4:
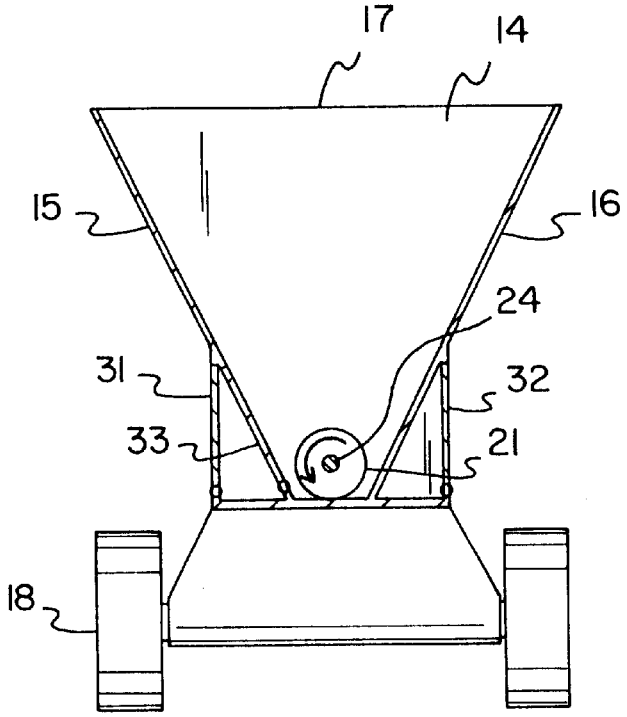
FIG. 4 is a schematic cross sectional view of the present invention taken from line 4—4 of FIG. 2.

With reference to the Figures, the hopper 12 has interior space, a top, a bottom, a pair of end walls 13,14, and a pair side walls 15,16 extending between the end walls 13,14. The interior space of the hopper 12 is designed for holding particulate, such as sand, therein. As illustrated in FIG. 4, the side walls 15,16 of the hopper 12 preferably extend upwardly and outwardly from the bottom of the hopper 12 towards the top of the hopper 12 such that the interior space has a generally V-shaped cross section. The V-shape is designed for directing sand towards the bottom of the interior space. The top of the hopper 12 has an opening 17 into the interior space of the hopper 12. The opening 17 of the top of the hopper 12 is designed for permitting filling of the interior space with sand. The bottom of the hopper 12 has ground engaging members 18 which ideally are wheels for permitting easy transport and positioning of the device 10. In an ideal illustrative embodiment, the hopper 12 has an ideal length of about 12 feet between its ends walls, an ideal height of about 7½ feet between the top and bottom, and an ideal width between side walls 15,16 of about 6 feet.

Figure 3:
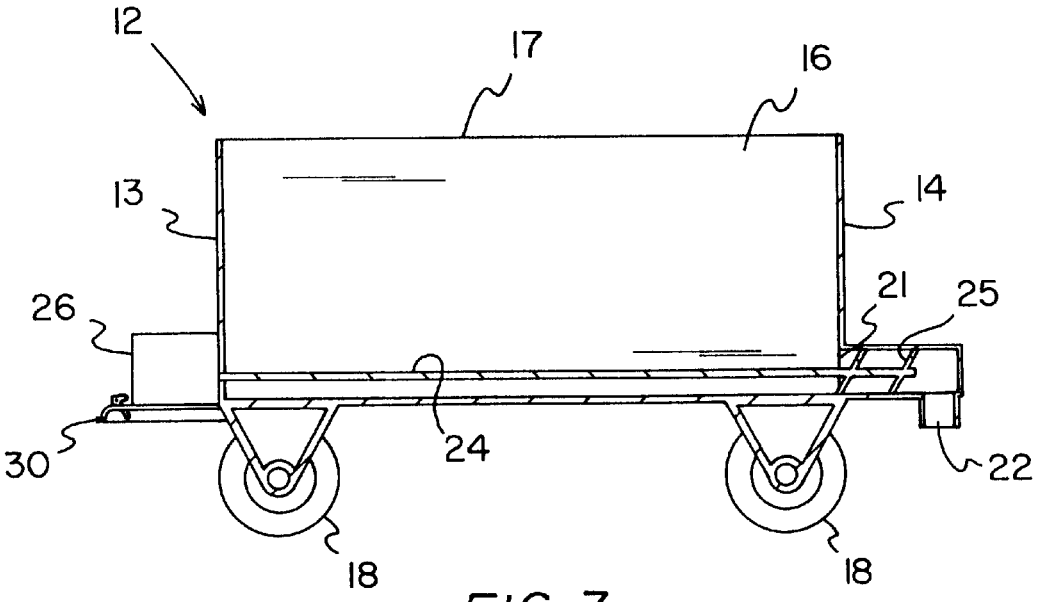
FIG. 3 is a schematic cross sectional view of the present invention taken from line 3—3 of FIG. 1.

With reference to FIG. 3, a conduit 20 outwardly extends from one of the end walls 14 of the hopper 12 away from the hopper 12. The conduit 20 is preferably positioned towards the bottom of the hopper 12. The conduit 20 has a first opening 21 into the interior space of the hopper 12 and a second opening 22 distal the one end wall 14 of the hopper 12. The second opening 22 is preferably orientated in a downwards direction towards the ground. The conduit 20 is designed for permitting the passage through it of sand in the interior space out through the second opening 22 so that sand bags positioned below the second opening 22 may be filled.

An auger member 24 having an elongate shaft and a screw portion 25 at one end is rotatably mounted in the interior space of the hopper 12. The auger member 24 extends from the interior space of the hopper 12 into the conduit 20 through the first opening 21 of the conduit 20 so that the screw portion 25 is extended into the conduit 20. The auger member 24 is rotatable in a direction such that sand in the interior space is directed through the conduit 20 by the screw portion 25. A motor 26 is provided for rotating the auger member 24 in a direction. The motor 26 is preferably located adjacent the other end wall 13 of the hopper 12 away from the conduit 20. A switch is electrically coupled to the motor 26. The switch has an actuator 27 for activating the switch. The actuator 27 is located on the conduit 20 adjacent the second opening 22 of the conduit 20. The switch permits selective activation of the motor 26 to rotate the auger member 24 by a user positioned proximal to the second opening 22 of the conduit 20. Ideally, the actuator 27 is an electric eye type of device such that the motor 26 is activated to rotate when a sand bag is positioned bellow the second opening 22 of the conduit 20.

In the ideal embodiment, the other end wall 13 of the hopper 12 has a hitch shaft 30 outwardly extending therefrom. The hitch shaft 30 is adapted for attachment to a hitch of a vehicle to permit towing of the device 10. The hopper 12 also ideally has a pair of exterior storage compartments 31,32 with each storage compartment located adjacent an associated side wall 15,16 of the hopper 12. Preferably, one of the side walls 15 of the hopper 12 further includes an access opening 33 into the interior space with an access panel substantially closing the access opening 33. The access opening 33 is designed for permitting convenient access to the auger member 24 for repairs and servicing.

In use, the interior space of the hopper 12 is filled with sand through the top opening 17. A sand bag is positioned bellow the second opening 22 of the conduit and the actuator is triggered to activate the motor 26. The auger member 24 is rotated by the motor to direct sand in the hopper 12 through the conduit 20 and into the sand bag to fill it.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for filling sandbags, comprising:

a hopper having interior space a top, a bottom, a pair of end walls, and a pair side walls extending between said end walls;

said top of said hopper having an opening into said interior space of said hopper;

said bottom of said hopper having ground engaging members;

a conduit being outwardly extended from one of said end walls of said hopper away from said hopper, said conduit having a first opening into said interior space of said hopper, said conduit having a second opening distal said one of said end walls of said hopper;

an auger member having a screw portion, said auger member being rotatably mounted in said interior space of said hopper, said auger member being extended from said interior space of said hopper into said conduit through said first opening of said conduit, said screw portion being extended into said conduit;

a motor for rotating said auger member in a direction;

wherein said side walls of said hopper are extended upwardly and outwardly from said bottom of said hopper towards said top of said hopper such that said interior space has a generally V-shaped cross section:

said hopper having a pair of exterior storage compartments, one of said storage compartments being located adjacent one of said side walls of said hopper, another of said storage compartments being located adjacent another of said side walls of said hoppe,r wherein each of said storage compartments being defined by a horizontally oriented substantially planar rectangular bottom wall extending from a bottom edge of one of said side walls of said hopper and a vertically oriented substantially planar rectangular peripheral wall mounted between an intermediate extent of one of said side walls of said hopper and said bottom wall, wherein a storage compartment access panel is hingably mounted to an access opening of each of said peripheral walls of said storage compartments;

one of said side walls of said hopper having an access opening into said interior space and being positioned within one of said storage compartments level with one of said storage compartment access panels, an auger access panel substantially closing said access opening of said side wall, said access opening of said side wall being for permitting convenient access to said auger member for repairs and servicing; and a switch being electrically coupled to said motor, said switch having an actuator for activating said switch, said actuator being located on said conduit adjacent said second opening of said conduit, said switch permitting selective activation of said motor to rotate said auger member by a user positioned proximal to said second opening of said conduit, wherein said actuator is an electric eye device such that said motor is activated to rotate when a bag is positioned below said second opening of said conduit.

2. The device of claim 1, wherein said ground engaging members comprise wheels.

3. The device of claim 1, wherein said second opening of said conduit is orientated in a downwards direction.

4. The device of claim 1, said motor being located adjacent another of said end walls of said hopper.

5. The device of claim 1, wherein another of said end walls of said hopper has a hitch shaft outwardly extending therefrom, said hitch shaft being adapted for attachment to a hitch of a vehicle.

6. A device for filling sandbags, comprising:

a hopper having interior space, a top, a bottom, a pair of end walls, and a pair side walls extending between said end walls, said interior space of said hopper being for holding particulate therein;

said side walls of said hopper being extended upwardly and outwardly from said bottom of said hopper towards said top of said hopper such that said interior space has a generally V-shape cross section, said V-shaped cross section being for directing sand towards said bottom of said interior space;

said top of said hopper having an opening into said interior space of said hopper, said opening of said top of said hopper being for permitting filling of said interior space with particulate;

said bottom of said hopper having ground engaging members, wherein said ground engaging members comprise wheels for facilitating transport and positioning of said device;

a conduit being outwardly extended from one of said end walls of said hopper away from said hopper, said conduit being positioned towards said bottom of said hopper, said conduit having a first opening into said interior space of said hopper, said conduit having a second opening distal said one of said end walls of said hopper, said second opening being orientated in a downwards direction towards said ground, said conduit being for permitting said passage therethrough of particulate in said interior space out through said second opening to permit filling of bags positioned below said second opening;

an auger member having an elongate shaft and a screw portion at one end, said auger member being rotatably mounted in said interior space of said hopper, said auger member being extended from said interior space of said hopper into said conduit through said first opening of said conduit, said screw portion being extended into said conduit, said auger member being rotatable in a direction such that sand in said interior space is directed through said conduit by said screw portion;

a motor for rotating said auger member in a direction, said motor being located adjacent another of said end walls of said hopper opposite from said conduit;

said another of said end walls of said hopper having a hitch shaft outwardly extending therefrom, said hitch shaft being adapted for attachment to a hitch of a vehicle to permit towing of said device;

said hopper having a pair of exterior storage compartments, one of said storage compartments being located adjacent one of said side walls of said hopper, another of said storage compartments being located adjacent another of said side walls of said hopper, wherein each of said storage compartments is defined by a horizontally oriented substantially planar rectangular bottom wall extending from a bottom edge of one of said side walls of said hopper and a vertically oriented substantially planar rectangular peripheral wall mounted between an intermediate extent of one of said side walls of said hopper and said bottom wall, wherein a storage compartment access panel is hingably mounted to an access opening of each of said peripheral walls of said storage compartments;

one of said side walls of said hopper having an access opening into said interior space and being positioned within one of said storage compartments level with one of said storage compartment access panels, an auger access panel substantially closing said access opening, said access opening of said side wall being for permitting convenient access to said auger member for repairs and servicing; and a switch being electrically coupled to said motor, said switch having an actuator for activating said switch, said actuator being located on said conduit adjacent said second opening of said conduit, said switch permitting selective activation of said motor to rotate said auger member by a user positioned proximal to said second opening of said conduit, wherein said actuator is an electric eye device such that said motor is activated to rotate when a bag is positioned below said second opening of said conduit.

* * * * *